US008036582B2

(12) United States Patent
Murata et al.

(10) Patent No.: US 8,036,582 B2
(45) Date of Patent: Oct. 11, 2011

(54) BELT DRIVING DEVICE AND IMAGE FORMING APPARATUS

(75) Inventors: Takuya Murata, Tokyo (JP); Kazuhiko Kobayashi, Tokyo (JP); Yuji Matsuda, Tokyo (JP); Yuichiro Ueda, Kanagawa (JP); Hiromichi Matsuda, Kanagawa (JP); Toshiyuki Andoh, Kanagawa (JP); Joh Ebara, Kanagawa (JP); Yohei Miura, Tokyo (JP); Takuya Uehara, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 366 days.

(21) Appl. No.: 12/385,429

(22) Filed: Apr. 8, 2009

(65) Prior Publication Data

US 2009/0263158 A1 Oct. 22, 2009

(30) Foreign Application Priority Data

Apr. 8, 2008 (JP) ..... 2008-100143
Jul. 14, 2008 (JP) ..... 2008-182205

(51) Int. Cl.
*G03G 15/01* (2006.01)

(52) U.S. Cl. ..... 399/302

(58) Field of Classification Search ..... 399/167, 399/302, 303, 312, 313, 162
See application file for complete search history.

(56) References Cited

U.S. PATENT DOCUMENTS

| | | | | |
|---|---|---|---|---|
| 5,995,802 | A * | 11/1999 | Mori et al. | 399/167 |
| 7,248,820 | B2 * | 7/2007 | Iwasaki | 399/167 |
| 2002/0122678 | A1 * | 9/2002 | Chapman et al. | 399/302 |
| 2007/0212127 | A1 * | 9/2007 | Yoshiyama et al. | 399/302 |

FOREIGN PATENT DOCUMENTS

| | | |
|---|---|---|
| JP | 3186610 | 5/2001 |
| JP | 2002-230537 | 8/2002 |
| JP | 2005-049413 | 2/2005 |
| JP | 3658262 | 3/2005 |
| JP | 2005-115398 | 4/2005 |
| JP | 2006-106642 | 4/2006 |

OTHER PUBLICATIONS

Abstract of JP 10-078734 published Mar. 24, 1998.
Abstract of JP 2000-310897 published Nov. 7, 2000.

* cited by examiner

*Primary Examiner* — Susan Lee
(74) *Attorney, Agent, or Firm* — Harness, Dickey & Pierce, P.L.C.

(57) ABSTRACT

In an image forming apparatus, during a rotation of an intermediate transfer belt performed after a contact-state-changing rotation in which the number of photoconductors contacting the intermediate transfer belt has changed, a control unit of a belt driving device controls the driving speed of a belt driving motor based on a period of the intermediate transfer belt determined in the rotation immediately before the contact-state-changing rotation instead of a period determined in the contact-state-changing rotation.

9 Claims, 6 Drawing Sheets

BELT DRIVING DEVICE AND IMAGE FORMING APPARATUS

BACKGROUND OF THE INVENTION

1. Field of the Invention

The present invention relates to a belt driving device for controlling the driving speed of a driving source of a driving/rotating body for endlessly moving a belt member by detecting the speed variation pattern during one rotation of the belt member. Furthermore, the present invention relates to an image forming apparatus such as a copier, a fax machine, and a printer, that is provided with such a belt driving device.

2. Description of the Related Art

Conventionally, such an image forming apparatus is known, as described in patent document 1. The image forming apparatus includes a transfer unit for endlessly moving an endless intermediate transfer belt acting as a belt member, which is stretched around a driving roller and plural subordinate rollers. The image forming apparatus includes four separate photoconductors corresponding to yellow, magenta, cyan, and black (hereinafter, "Y, M, C, and K") as image carriers. The Y, M, C, and K toner images separately formed on the corresponding photoconductors are sequentially superposed on the intermediate transfer belt by the transfer unit, to form a full-color image. In another example of an image forming apparatus, instead of using an intermediate transfer belt, a sheet conveying belt for conveying a recording sheet held on its endlessly moving surface may be used. The Y, M, C, and K toner images formed on the corresponding Y, M, C, and K photoconductors are directly transferred and superposed on the recording sheet on the sheet conveying belt. The method performed by these image forming apparatuses is referred to as a tandem method, in which plural image carriers are provided, toner images of colors are formed on the corresponding image carriers, and the toner images are transferred and superposed on the surface of a belt member or on a recording sheet on the belt member.

In a tandem-type image forming apparatus, when the speed of the belt member varies, the toner images of the respective colors, which are transferred and superposed on the belt member or the recording sheet, may be displaced from one another, thereby causing so-called color shift (displacement of colors). One of the factors causing the speed variation of the belt member may be the inconsistency in the thickness of the belt member (belt thickness inconsistency) in the circumferential direction. When a relatively thick part of the belt member is wound around the driving roller which drives the belt member, the belt moving speed increases. Conversely, when a relatively thin part of the belt member is wound around the driving roller which drives the belt member, the belt moving speed decreases. In this manner, the speed varies during one rotation of the belt member. A belt member that has been manufactured by a centrifugal molding technique is likely to have an inconsistent thickness due to the eccentricity of the die, in which the thickest portion and the thinnest portion may have a phase difference of 180° within one rotation of the belt. The speed variation during one rotation of the belt depicts a sine curve corresponding to one period.

In the image forming apparatus described in patent document 1, an encoder is provided for the subordinate rollers that are rotated by the endless movement of the intermediate transfer belt that is stretched around the subordinate rollers. Based on output pulses from this encoder, the endless movement speed of the belt is detected. The detected endless movement speed is stored in predetermined periods to determine the speed variation pattern during one rotation of the belt. The driving speed of the driving motor which is the driving source of the driving roller is adjusted so that the driving speed has an opposite phase to that of the waveform of the speed variation pattern. In this manner, the driving speed of the belt is adjusted, to drive the belt at various speeds in such a manner as to cancel out the speed variation caused by the belt thickness inconsistency. As a result, the intermediate transfer belt can move at a stable speed.

In order to control the driving speed of the driving motor, it is necessary to determine a reference timing indicating when a predetermined reference portion of the intermediate transfer belt rotates once in the circumferential direction (endless movement direction). There is known a method of determining such a reference timing, performed with the use of a home position sensor. In this method, a home position mark is applied to the reference position of a belt member such as an intermediate transfer belt, and a home position sensor for detecting the home position mark is fixed at a predetermined position near the belt member. The reference timing is acquired as the home position sensor detects the home position mark.

Patent Document 1: Japanese Laid-Open Patent Application No. 2006-106642

However, this method incurs increased costs for applying a home position mark on the belt member and providing a home position sensor.

Accordingly, the inventors of the present invention are developing an image forming apparatus employing the following method for determining the reference timing without the use of a home position sensor. Specifically, as described above, the waveform of the speed variation pattern caused by the belt thickness inconsistency during one rotation is depicted by a sine curve corresponding to one period. The timing when a portion of a predetermined waveform appears, such as the maximum value, the minimum value, or the mean value of the sine curve, can be considered to be the reference timing when a virtual reference portion of the belt enters a virtual home position. During a printing job, the driving speed of the driving motor is adjusted to reduce speed variations of the belt member. The waveform of the speed variation pattern formed due to the belt thickness inconsistency can be extracted based on the difference between the belt speed detected by the encoder and the driving speed. The reference timing is specified based on the waveform thus extracted. Based on the specified reference timing, the driving speed of the belt is adjusted during the rotation of the belt beyond the reference timing. With such a configuration, the cost required for providing a home position sensor can be eliminated.

However, with a belt driving device having such a configuration, when the image carrier (for example, a photoconductor) and the belt member are separated from each other, the reference timing determined during this rotation may be significantly erroneous. Specifically, when a tandem type image forming apparatus is in a monochrome mode for forming monochrome images, usually only the K image carrier, among the Y, M, C, and K image carriers, contacts the belt member to perform the image forming operation. Furthermore, when new image information is received during an image forming operation, the image forming operation for the new image information is performed immediately after the previous image forming operation, without stopping the image carrier or the belt member. Assuming that the image forming apparatus with such a configuration uses the above-described virtual home position, the following problems arise. When color image information is received while performing the image forming operation in the monochrome mode, the following series of operations are performed. That is, when the image forming operation in the monochrome mode ends, the Y, M, and C photoconductors, which had been separated from the belt member, come in contact with the belt member, while the belt member is continuously driven. Accordingly, the image forming operation in the color mode starts while the belt member is continuously driven. During these operations, when the Y, M, and C photoconductors come in contact with the belt member, the load on the driving motor may rapidly increase, which may instantaneously significantly decrease the moving speed of the belt member. As a result, the waveform of the speed variation pattern may become considerably irregular. Accordingly, the image forming apparatus may erroneously detect a timing of a waveform, which does not correspond to the virtual reference portion of the belt member, as being the reference timing corresponding to when the reference portion enters the virtual home position. Such an erroneous detection causes a considerable error in determining the reference timing. Furthermore, when monochrome image information is received while an image forming operation is being performed in the color mode, the Y, M, and C image carriers which have been in contact with the belt member are separated from the belt member as the color mode image forming operation ends. In this case, the load on the driving motor may rapidly decrease, which may instantaneously significantly increase the moving speed of the belt member. Such an instantaneous increase in the moving speed may cause a considerable error in determining the reference timing.

When there is a considerable error in determining the reference timing of the belt member, the moving speed of the belt member cannot be properly stabilized in the subsequent rotation, which leads to considerable color shift.

The above describes the problems that arise in a configuration of making an image carrier come in contact with/separate from a belt member. The same problems arise when making any other opposing member facing the belt member come in contact with/separate from the belt member. For example, a belt cleaning device for cleaning off residual toner remaining on the surface of the belt member after the transfer process, or an opposing member such as a transfer member for contacting the surface of the belt member to form a transfer nip, may be configured to come in contact with/separate from the belt member, which leads to the same problems as described above.

SUMMARY OF THE INVENTION

The present invention provides a belt driving device and an image forming apparatus in which one or more of the above-described disadvantages are eliminated.

A preferred embodiment of the present invention provides a belt driving device and an image forming apparatus capable of preventing color shift caused by errors in determining the reference timing when an image carrier or an opposing member contacts/separates from a belt member, without the need for a home position sensor that incurs increased cost.

According to an aspect of the present invention, there is provided a belt driving device installed in an image forming apparatus, wherein the image forming apparatus includes plural image carriers each configured to carry a visible image; a visible image forming unit configured to form the visible images on the corresponding image carriers; an image forming control unit configured to control the visible image forming unit; a transfer unit configured to transfer the visible images on the image carriers so as to be superposed on a surface of a belt member having an endless form configured to endlessly move, or on a recording member held on the surface; and a contact/separation unit configured to cause the surface of the belt member to contact/separate from at least one of the image carriers, or to cause the belt member to contact/separate from an opposing member facing the belt member, wherein the belt driving device includes a driving rotary body configured to endlessly move the belt member by a rotational drive thereof, while having an inner loop of the belt member stretched around the driving rotary body; a subordinate rotary body configured to be rotated by the endless movement of the belt member while being in contact with the belt member; a first detecting unit configured to detect a driving speed at which the driving rotary body is driven; a second detecting unit configured to detect rotational angular displacement or a rotational angular speed of the subordinate rotary body; and a belt driving control unit configured to determine a reference timing of a preceding rotation of the belt member and a speed variation pattern of the belt member during the preceding rotation based on detection data obtained by the first detecting unit in the preceding rotation and detection data obtained by the second detecting unit in the preceding rotation, and to control, during a succeeding rotation which is continuously performed after the preceding rotation, the driving speed of a driving source configured to drive the driving rotary body, based on the reference timing and the speed variation pattern, wherein during a rotation of the belt member after a contact-state-changing rotation, the belt driving control unit controls the driving speed of the driving source based on a reference timing determined in a rotation of the belt member before the contact-state-changing rotation, instead of a reference timing determined in the contact-state-changing rotation, wherein the contact-state-changing rotation corresponds to a rotation of the belt member in which a number of the image carriers contacting the belt member changes, or a rotation of the belt member in which the opposing member that has been separated from the belt member comes in contact with the belt member, or a rotation of the belt member in which the opposing member that has been in contact with the belt member separates from the belt member.

According to one embodiment of the present invention, a belt driving device and an image forming apparatus are provided, which are capable of preventing color shift caused by errors in determining the reference timing when an image carrier or an opposing member contacts/separates from a belt member, without the need for a home position sensor that incurs increased cost.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

A description is given, with reference to the accompanying drawings, of embodiments of the present invention.

An electrophotographic printer (hereinafter, simply referred to as "printer") is taken as an example of an image forming apparatus to which an embodiment of the present invention is applied.

Figure 1:
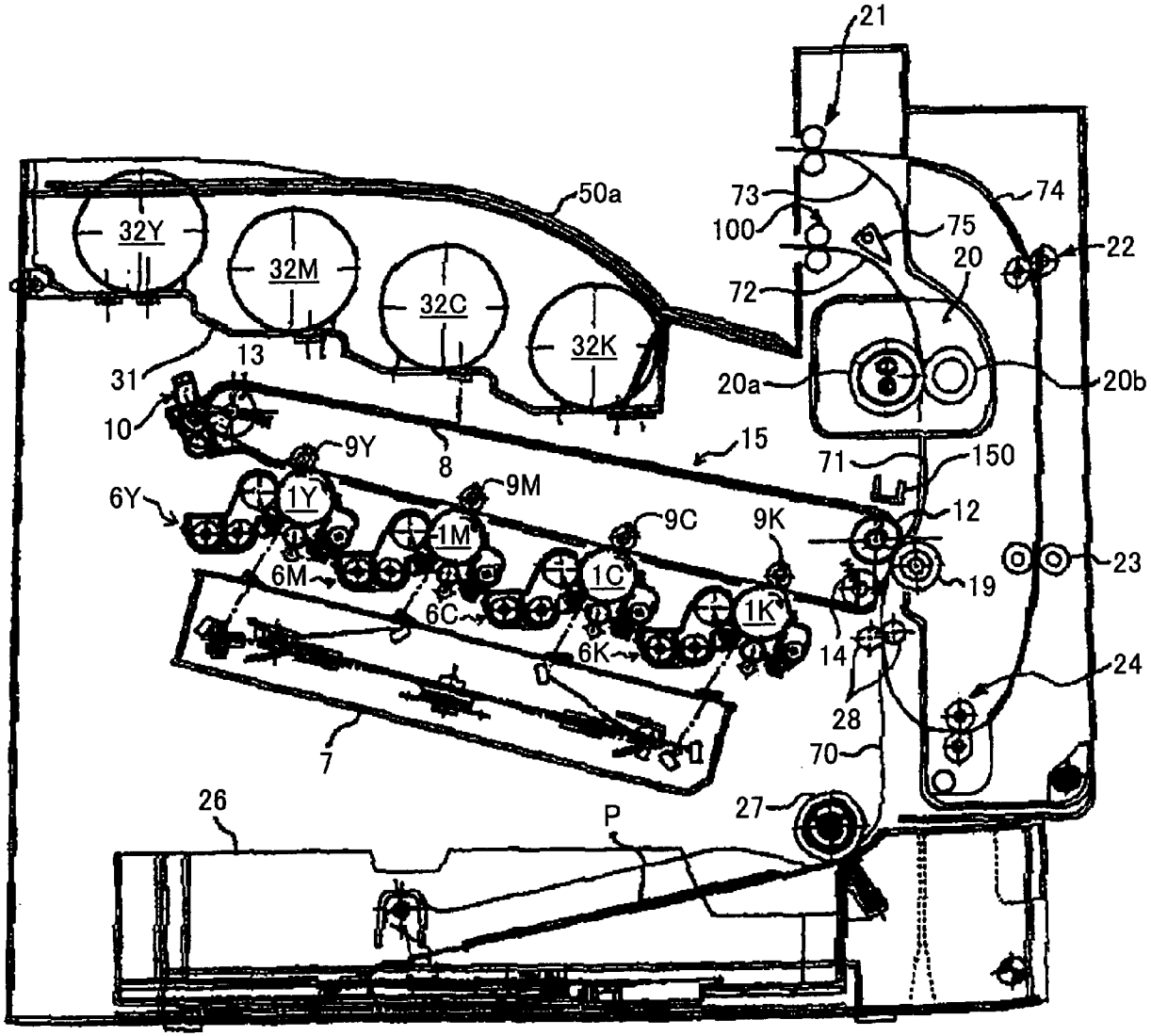
FIG. 1 is a schematic diagram of a printer according to an embodiment of the present invention.
Figure 2:
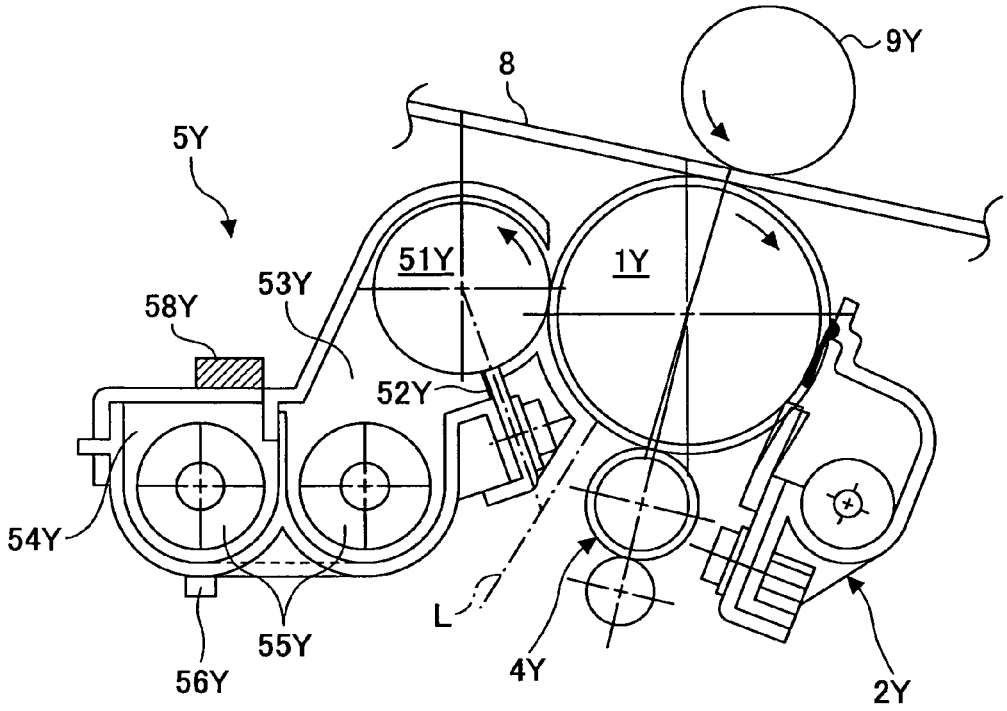
FIG. 2 is an enlarged view of a process unit for Y and a surrounding configuration included in the printer.

A description is given of the basic configuration of the printer. FIG. 1 is a schematic diagram of the printer. As, the printer includes four process units 6Y, 6M, 6C, and 6K for forming toner images of yellow, magenta, cyan, and black (hereinafter, "Y, M, C, and K"). These process units 6Y, 6M, 6C, and 6K use toner Y, M, C, and K of different colors as the image forming substance, but otherwise have the same configuration. Each process unit is replaced with a new one when its operating life comes to an end. As shown in FIG. 2, the process unit 6Y for generating Y toner images, which is taken as an example, includes a drum type photoconductor 1Y acting as a latent image carrier, a drum cleaning device 2Y, a discharging device (not shown), a charging device 4Y, and a developing unit 5Y. The process unit 6Y is detachably attached to the printer main body, so that the consumable parts can be replaced all at once.

The charging device 4Y uniformly charges the surface of the photoconductor 1Y acting as an image carrier that is rotated in a clockwise direction as viewed in the figure by a driving unit (not shown). The uniformly-charged surface of the photoconductor 1Y is subjected to exposure scanning by a laser beam L, so that an electrostatic latent image for Y is carried on the photoconductor 1Y. The Y electrostatic latent image is developed into a Y toner image by the developing unit 5Y with the use of a Y developer including Y toner and magnetic carriers. Then, the Y toner image is transferred by an intermediate transfer procedure onto an intermediate transfer belt 8. The drum cleaning device 2Y removes toner remaining on the surface of the photoconductor 1Y after the intermediate transfer procedure. The discharging device discharges the residual electric charges remaining on the photoconductor 1Y after the cleaning procedure. By performing this discharging procedure, the surface of the photoconductor 1Y is initialized, so as to be prepared for the next image forming operation. In each of the other process units (6M, 6C, and 6K), in a similar manner to that of the process unit 6Y, a toner image (M, C, and K) is formed on the photoconductor (1M, 1C, and 1K), and the toner image is transferred onto the intermediate transfer belt 8 acting as a belt member.

The developing unit 5Y includes a developing roller 51Y that is disposed so as to be partially exposed from the opening of the casing of the developing unit 5Y. The developing unit 5Y also includes two conveying screws 55Y disposed in parallel, a doctor blade 52Y, and a toner density sensor (hereinafter, "T sensor") 56Y.

Inside the casing of the developing unit 5Y, Y developer (not shown) is accommodated, which includes magnetic carriers and Y toner. The Y developer is friction-charged by being stirred and conveyed by the two conveying screws 55Y, and is then carried on the surface of the developing roller 51Y. Subsequently, the layer thickness of the Y developer is adjusted by the doctor blade 52Y. Then, the Y developer is conveyed to a developing region for Y facing the photoconductor 1Y, and at the Y developing region, the Y toner is adhered to the electrostatic latent image on the photoconductor 1Y. In the developing unit 5Y, the Y developer in which the Y toner has been consumed due to developing, is returned inside the casing as the developing roller 51Y rotates.

A partitioning wall is provided between the two conveying screws 55Y. This partitioning wall divides a first supplying unit 53Y accommodating the developing roller 51Y and the conveying screw 55Y shown on the right in the figure, and a second supplying unit 54Y accommodating the conveying screw 55Y shown on the left in the figure. The conveying screw 55Y shown on the right in the figure is rotated by a driving unit (not shown) for supplying the Y developer in the first supplying unit 53Y to the developing roller 51Y, while conveying the Y toner from the front side toward the back side as viewed in the figure. The Y developer that has been conveyed near to the edge of the first supplying unit 53Y by the conveying screw 55Y shown on the right in the figure passes through an opening (not shown) provided in the partitioning wall, and enters the second supplying unit 54Y. In the second supplying unit 54Y, the conveying screw 55Y shown on the left in the figure is rotated by a driving unit (not shown), and conveys the Y developer received from the first supplying unit 53Y in a direction opposite to that in which the Y developer has been conveyed by the conveying screw 55Y shown on the right in the figure. The Y developer that has been conveyed near to the edge of the second supplying unit 54Y by the conveying screw 55Y shown on the left in the figure, is returned to the first supplying unit 53Y through another opening (not shown) provided in the partitioning wall.

The T sensor 56Y configured with a magnetic permeability sensor is provided on the bottom wall of the second supplying unit 54Y, and outputs a voltage corresponding to the magnetic permeability of the Y developer passing above the T sensor 56Y. The magnetic permeability of a two component developer including toner and magnetic carriers is closely correlated with the toner density. Therefore, the T sensor 56Y outputs a voltage corresponding to the density of the Y toner. The value of this output voltage is sent to a control unit (not shown). The control unit includes a RAM storing a Vtref for Y which is the target value of the output voltage from the T sensor 56Y. The RAM stores data of a Vtref for M, a Vtref for C, and a Vtref for K, which are target values of output voltages from T sensors (not shown) provided in the other developing units. The Vtref for Y is used for controlling the operation of driving the toner conveying device for Y described below. Specifically, the control unit controls the operation of driving the toner conveying device for Y (not shown) for supplying Y toner into the second supplying unit 54Y so that the output value from the T sensor 56Y approaches the Vtref for Y. By supplying the Y toner, the Y toner density in the Y developer accommodated in the developing unit 5Y can be maintained within a predetermined range. The toner supply is controlled in the same manner with the use of the toner conveying devices for M, C, and K, in the developing units of the other process units.

As shown in FIG. 1, an optical writing unit 7 is provided beneath the process units 6Y, 6M, 6C, and 6K, as a latent image writing device. The optical writing unit 7 emits laser beams L based on image information, and radiates the laser beams L onto the photoconductors of the process units 6Y, 6M, 6C, and 6K, by the exposing procedure. By performing this exposing procedure, electrostatic latent images for Y, M, C, and K are formed on the photoconductors 1Y, 1M, 1C, and 1K, respectively. The optical writing unit 7 radiates the laser beams (L) emitted from a light source onto the corresponding photoconductors via plural optical lenses and mirrors, while scanning the laser beams (L) with a polygon mirror rotated by a motor.

Beneath the optical writing unit 7 as viewed in the figure, there is provided a sheet storing unit including a sheet storing cassette 26 and a sheet feeding roller 27 built in the sheet storing cassette 26. In the sheet storing cassette 26, plural transfer sheets P acting as recording bodies are stacked, and the sheet feeding roller 27 contacts the top transfer sheet P. When the sheet feeding roller 27 is rotated by a driving unit (not shown) in a counterclockwise direction as viewed in the figure, the top transfer sheet P is sent out toward a sheet feeding path 70.

A pair of resist rollers 28 is disposed near the trailing edge of the sheet feeding path 70. Both of the resist rollers 28 are rotated in order to sandwich the transfer sheet P, and as soon as the transfer sheet P is sandwiched, the rotation is temporarily stopped. Then, at an appropriate timing, the transfer sheet P is sent out to a secondary transfer nip described below.

Above the process units 6Y, 6M, 6C, and 6K as viewed in the figure, there is disposed a transfer unit 15 for endlessly moving the intermediate transfer belt 8 acting as a belt member which is stretched around rollers. The transfer unit 15 acting as a belt driving device includes, in addition to the intermediate transfer belt 8, a secondary transfer bias roller 19 and a belt cleaning device 10. The transfer unit 15 also includes four primary transfer bias rollers 9Y, 9M, 9C, and 9K, a driving roller 12, a cleaning backup roller 13, and an encoder roller 14. The intermediate transfer belt 8 is stretched around these seven rollers, and is endlessly moved in a counterclockwise direction as viewed in the figure by the rotation of the driving roller 12. The intermediate transfer belt 8 being endlessly moved is sandwiched by the primary transfer bias rollers 9Y, 9M, 9C, and 9K and the photoconductors 1Y, 1M, 1C, and 1K, respectively, so that primary transfer nips are formed at the sandwiched portions. A transfer bias having an opposite polarity to that of the toner (for example, positive) is applied on the back side of the intermediate transfer belt 8 (inner peripheral surface of loop). The rollers other than the primary transfer bias rollers 9Y, 9M, 9C, and 9K are electrically connected to ground. As the intermediate transfer belt 8 endlessly moves and sequentially passes through the primary transfer nips for Y, M, C, and K, the Y, M, C, and K toner images respectively formed on the photoconductive drums 1Y, 1M, 1C, and 1K are superposed on the intermediate transfer belt 8 by a primary transfer procedure. Accordingly, a four-color superposed toner image is formed on the intermediate transfer belt 8 (hereinafter, "four-color toner image").

A secondary transfer nip is formed where the intermediate transfer belt 8 is sandwiched by the driving roller 12 and the secondary transfer bias roller 19. The visible four-color toner image formed on the intermediate transfer belt 8 is transferred onto the transfer sheet P at the secondary transfer nip. As the four-color toner image is placed on the white transfer sheet P, a full-color toner image is formed. On the intermediate transfer belt 8 that has passed through the secondary transfer nip, residual toner is adhering, which has failed to be transferred to the transfer sheet P. This residual toner is cleaned off by the belt cleaning device 10. The transfer sheet P, onto which the four-color toner image has been transferred in one step by the secondary transfer procedure at the secondary transfer nip, is sent to a fixing device 20 through a post-transfer conveying path 71.

In the fixing device 20, a fixing nip is formed by a fixing roller 20*a* and a pressure roller 20*b*. The fixing roller 20*a* has a heating source such as a halogen lamp provided inside, and the pressure roller 20*b* is rotated while being pressed against the fixing roller 20*a* at a predetermined pressure. The transfer sheet P that has been sent into the fixing device 20 is sandwiched at the fixing nip so that the side of the transfer sheet P with an unfixed toner image comes in close contact with the fixing roller 20*a*. Then, heat and pressure are applied to soften the toner in the toner image, thereby fixing the full-color image onto the transfer sheet P.

The transfer sheet P, on which a full-color image has been fixed at the fixing device 20, exits the fixing device 20 and approaches a branch point of a sheet eject path 72 and a pre-reverse conveying path 73. At the branch point, there is provided a first switching valve 75 that can oscillate. The path of the transfer sheet P can be switched by oscillating the first switching valve 75. Specifically, by moving the tip of the valve 75 toward the pre-reverse conveying path 73, the path of the transfer sheet is directed toward the sheet eject path 72. By moving the tip of the valve 75 away from the pre-reverse conveying path 73, the path of the transfer sheet is directed toward the pre-reverse conveying path 73.

When the path toward the sheet eject path 72 is selected with the first switching valve 75, the transfer sheet P passes through the sheet eject path 72 and a pair of sheet eject rollers 100, to be ejected outside of the printer and stacked onto a stacking part 50*a* provided on top of the printer casing. Conversely, when the path toward the pre-reverse conveying path 73 is selected with the first switching valve 75, the transfer sheet P passes through the pre-reverse conveying path 73 and enters the nip between a pair of reversion rollers 21. The pair of reversion rollers 21 is configured to convey the transfer sheet P sandwiched therebetween toward the stacking part 50*a*. Immediately before the trailing edge of the transfer sheet P enters the nip, the pair of reversion rollers 21 rotates in the reverse direction, so that the transfer sheet P is conveyed in the opposite direction, and the trailing edge of the transfer sheet enters a reverse conveying path 74.

The reverse conveying path 74 extends from the top to the bottom in a vertical direction in a curved manner, and includes a pair of first reverse conveying rollers 22, a pair of second reverse conveying rollers 23, and a pair of third reverse conveying rollers 24. The transfer sheet P is conveyed by sequentially passing through the nips of these roller pairs, so as to be reversed in the vertical direction. The transfer sheet P that has been reversed in the vertical direction returns to the sheet feeding path 70 and approaches the secondary transfer nip once again. Then, the side of the transfer sheet P without an image comes in close contact with the intermediate transfer belt 8 and enters the secondary transfer nip. A second four-color toner image on the intermediate transfer belt 8 is transferred in one step onto the side without an image, by a secondary transfer procedure. Subsequently, the transfer sheet P passes through the post-transfer conveying path 71, the fixing device 20, the sheet eject path 72, and the pair of sheet eject rollers 100, and is stacked on the stacking part 50*a* outside of the printer. When such a reverse conveying procedure is completed, full-color images are formed on both sides of the transfer sheet P.

A bottle supporting unit 31 is provided in between the transfer unit 15 and the stacking part 50*a* so as to be situated above the transfer unit 15. The bottle supporting unit 31 is equipped with toner bottles 32Y, 32M, 32C, and 32K acting as toner accommodating units for accommodating Y, M, C, and K toner, respectively. The toner bottles 32Y, 32M, 32C, and 32K are aligned at a slight angle with respect to a horizontal alignment, so that the positions of the bottles become higher in an ascending order of K, C, M, and Y. The Y, M, C, and K toner in the toner bottles 32Y, 32M, 32C, and 32K is supplied as needed to the developing units in the process units 6Y, 6M, 6C, and 6K, respectively, by a toner conveying device described below. The toner bottles 32Y, 32M, 32C, and 32K are detachably attached to the main unit of the printer, and are provided separately from the process units 6Y, 6M, 6C, and 6K.

In this printer, the photoconductors in contact with the intermediate transfer belt 8 are different for the monochrome mode for forming monochrome images and for the color mode for forming color images. Specifically, among the four primary transfer bias rollers 9Y, 9M, 9C, and 9K in the transfer unit 15, the primary transfer bias roller 9K is supported by a dedicated bracket (not shown), separate from the other primary transfer bias rollers. The three primary transfer bias rollers 9Y, 9M, and 9C for Y, M, and C, respectively, are supported by a common movable bracket (not shown). The movable bracket is driven by a solenoid (not shown) so as to be moved toward and away from the photoconductors 1Y, 1M, and 1C for Y, M, and C, respectively. When the movable bracket is moved away from the photoconductors 1Y, 1M, and 1C, the position of the stretched intermediate transfer belt 8 changes, such that the intermediate transfer belt 8 separates from the three photoconductors 1Y, 1M, and 1C for Y, M, and C. However, the photoconductor 1K for K remains in contact with the intermediate transfer belt 8. In this manner, in the monochrome mode, the image forming operation is performed with only the photoconductor 1K for K being in contact with the intermediate transfer belt 8.

When the movable bracket is moved toward the three photoconductors 1Y, 1M, and 1C, the position of the stretched intermediate transfer belt 8 changes, such that the intermediate transfer belt 8 that has been separated from the three photoconductors 1Y, 1M, and 1C comes in contact with the three photoconductors 1Y, 1M, and 1C. In the meantime, the photoconductor 1K for K remains in contact with the intermediate transfer belt 8. In this manner, in the color mode, the image forming operation is performed with all of the four photoconductors 1Y, 1M, 1C, and 1K being in contact with the intermediate transfer belt 8. In such a configuration, the movable bracket and the solenoid function as a contact/separation unit for making the photoconductors contact/separate from the intermediate transfer belt 8.

The printer includes a main control unit (not shown) acting as an image forming control unit for controlling the four process units 6Y, 6M, 6C, and 6K, and the optical writing unit 7. The main control unit includes a CPU (Central Processing Unit) acting as a processing unit, a RAM (Random Access Memory) acting as a data storing unit, and a ROM (Read Only Memory) acting as a data storing unit, and controls the process units and the optical writing unit based on programs stored in the ROM.

The transfer unit 15 includes a belt driving control unit (not shown). The belt driving control unit includes a CPU, a ROM, and a non-volatile RAM acting as a data storing unit, and controls a belt driving motor described below based on programs stored in the ROM.

Figure 3:
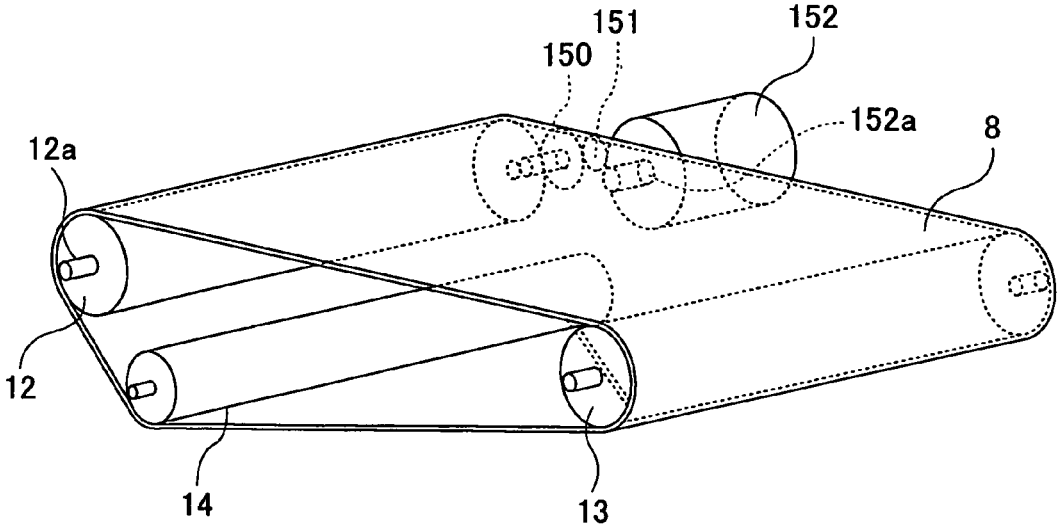
FIG. 3 is a perspective view of an intermediate transfer belt and a surrounding configuration included in the printer.

FIG. 3 is a perspective view of the intermediate transfer belt 8 and a surrounding configuration. As shown in FIG. 3, the driving roller 12, which endlessly moves the intermediate transfer belt 8, is configured to receive a rotational driving force transmitted via a transmission mechanism from a belt driving motor 152 acting as a driving source. Specifically, the rotational driving force from the belt driving motor 152 is transmitted to an output shaft 152*a* of the motor 152. The rotational driving force transmitted to the output shaft 152*a* is transmitted to a first gear 151 that is in mesh contact with the output shaft 152*a*, and is then transmitted to a second gear 150 that is in mesh contact with the first gear 151. The second gear 150 is fixed to a rotary shaft member 12*a* of the driving roller 12, so as to rotate together with the rotary shaft member 12*a*. Accordingly, when the second gear 150 rotates, the driving roller 12 rotates.

Figure 4:
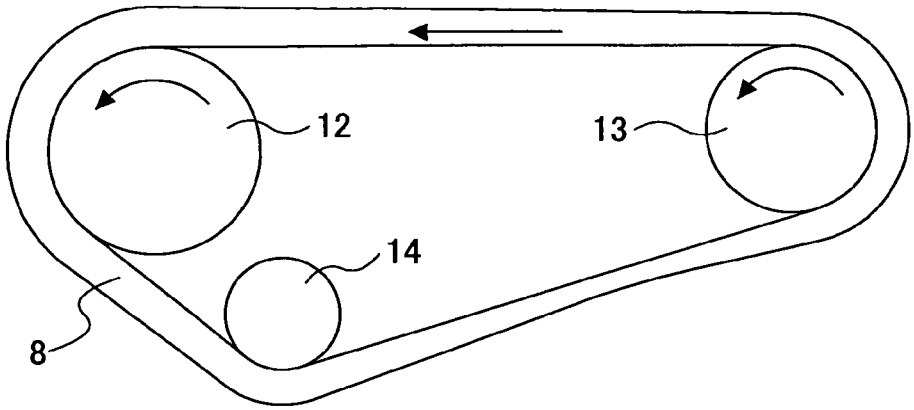
FIG. 4 is an enlarged schematic view of the intermediate transfer belt and three rollers around which the intermediate transfer belt is stretched.
Figure 5:
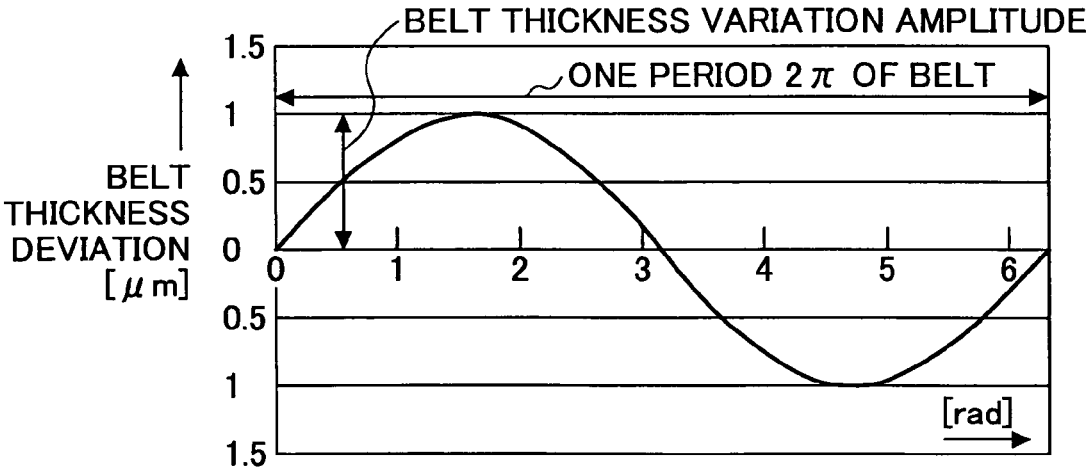
FIG. 5 is a graph indicating a speed variation during one rotation of the intermediate transfer belt.

FIG. 4 is an enlarged schematic view of the intermediate transfer belt 8 and the three rollers around which the intermediate transfer belt 8 is stretched. The intermediate transfer belt 8 in the printer has been manufactured by a centrifugal molding technique. As shown in FIG. 4, the intermediate transfer belt 8 has an inconsistent thickness, in which the thickest portion and the thinnest portion have a phase difference of 180° within one rotation of the belt. In FIG. 4, the thickest portion of the intermediate transfer belt 8 is wound around the driving roller 12. In this state, the intermediate transfer belt 8 moves at maximum speed, compared to the other states during one rotation of the belt. Conversely, when the thinnest portion of the intermediate transfer belt 8 is wound around the driving roller 12, the intermediate transfer belt 8 moves at minimum speed, compared to the other states during one rotation of the belt. In such a configuration, the speed variation during one rotation of the intermediate transfer belt 8 is depicted by a sine curve corresponding to one period, as shown in FIG. 5.

Next, a description is given of a characteristic configuration of the printer.

Figure 6:
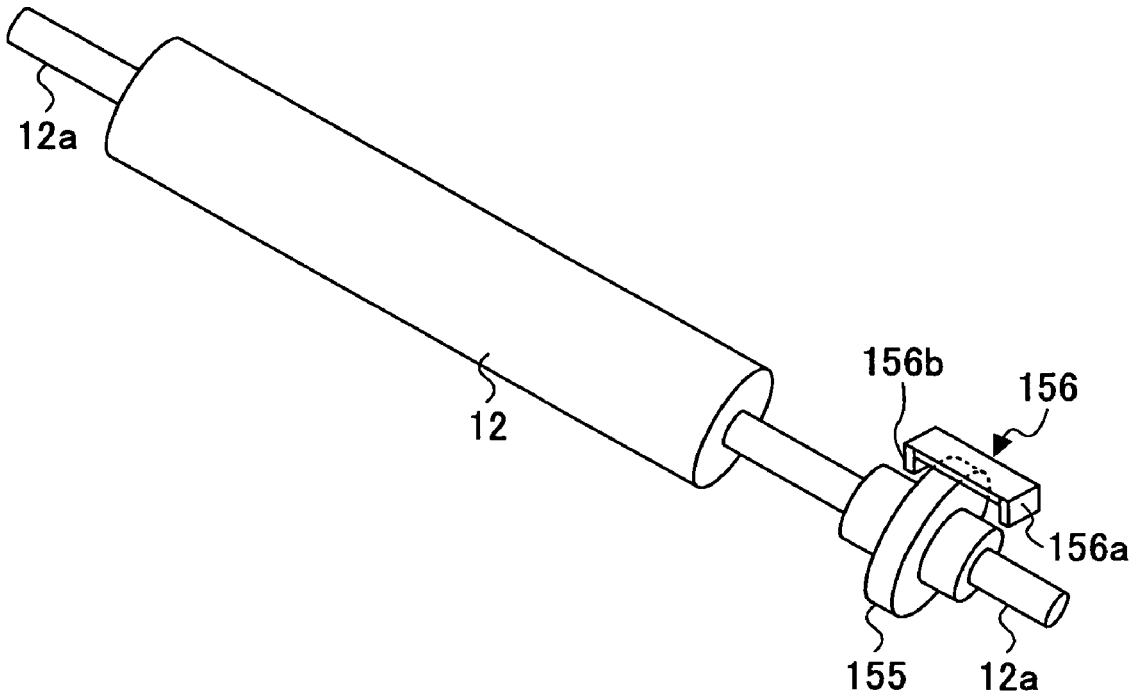
FIG. 6 is an enlarged perspective view of a driving roller of a transfer unit included in the printer.

FIG. 6 is an enlarged perspective view of the driving roller 12 acting as a driving rotary body. A rotary disk 155, of a driving encoder acting as a first detecting unit constituted by a rotary encoder, is fixed to one of the ends of the rotary shaft member 12*a*, which ends protrude from corresponding end faces of the roller part of the driving roller 12. In addition to the rotary disk 155, the driving encoder includes an optical sensor 156 fixed to a side board of the transfer unit (not shown).

In the optical sensor 156, a light-emitting diode 156*a* and a light-receiving diode 156*b* face each other with the rotary disk 155 disposed in between. The rotary disk 155 has plural slits (not shown) arranged at a predetermined pitch around its circumferential direction. The light emitted from the light-emitting diode 156*a* passes through a slit of the rotary disk 155, and is detected by the light-receiving diode 156*b*. However, as the rotary disk 155 rotates together with the driving roller 12, the light is temporarily blocked. Only when the light from the light-emitting diode 156*a* is received, the light-receiving diode 156*b* outputs a signal to the belt driving control unit. The on/off operation per signal output from the light-receiving diode 156*b* indicates predetermined rotational angular displacement of the driving roller 12. The pulse signals output from the light-receiving diode 156*b* indicate the rotational angular speed of the driving roller 12. Accordingly, the driving encoder functions as the first detecting unit for detecting the rotational angular displacement and the rotational angular speed of the driving roller 12. When a stepping motor is used as the belt driving motor 152, the rotational angular displacement and the rotational angular speed of the driving roller 12 can be identified based on the number of driving pulses output to the belt driving motor 152, and therefore there is no need to provide a driving encoder. In this case, the motor driver that outputs a driving pulse to the belt driving motor 152 functions as the first detecting unit for detecting the rotational angular displacement and the rotational angular speed of the driving roller 12.

A rotary disk of a subordinate encoder (not shown) having the same configuration as that of the driving encoder, is fixed to the encoder roller 14 acting as a subordinate rotary body. The subordinate encoder functions as a second detecting unit for detecting the rotational angular displacement and the rotational angular speed of the encoder roller 14.

The belt driving control unit of the transfer unit 15 controls the driving speed of the belt driving motor 152 acting as a driving source, and also controls the driving operation of the solenoid for making the intermediate transfer belt 8 contact/separate from the photoconductors 1Y, 1M, and 1C for Y, M, and C, respectively. However, the belt driving control unit for controlling the driving speed of the belt driving motor 152 and the contact/separation unit for making the intermediate transfer belt 8 contact/separate from the photoconductors 1Y, 1M, and 1C for Y, M, and C, respectively, can be provided as separate bodies. In this case, the contact/separation unit sends signals to the belt driving control unit to allow the belt driving control unit to determine the status of contact/separation.

Based on the reference timing and the speed variation pattern within one rotation of the intermediate transfer belt 8 determined in a previous rotation, the belt driving control unit controls the driving speed of the belt driving motor 152 for subsequent rotations of the intermediate transfer belt 8. Specifically, in each rotation of the intermediate transfer belt 8, data pertaining to the belt speed is sampled at predetermined periods, and the data is stored in the non-volatile RAM. In each rotation, when data corresponding to substantially one rotation has been sampled, the "speed variation pattern caused by the belt thickness inconsistency" and the actual speed variation pattern of the intermediate transfer belt 8 are detected, based on the data stored in the non-volatile RAM. Specifically, the difference between the data based on pulse signals from the driving encoder and the data based on the pulse signals from the subordinate encoder indicates the displacement amount from the reference speed, which is caused by the belt thickness inconsistency of the intermediate transfer belt 8. The properties of temporal changes in the displacement amount correspond to the "speed variation pattern caused by the belt thickness inconsistency" of the intermediate transfer belt 8. The belt driving control unit obtains the above-described difference while sequentially sampling the pulse signals from both encoders at predetermined periods, and stores the results in the non-volatile RAM. When difference data corresponding to substantially one rotation is obtained, the belt driving control unit analyzes the waveform of the "speed variation pattern caused by the belt thickness inconsistency" based on the obtained difference data, and identifies the reference timing for that particular rotation. After the belt driving control unit transfers the speed variation pattern to the non-volatile RAM, the belt driving control unit erases the difference data from the RAM. The periods and the starting point of the rotation of the belt member are determined based on the timing when a predetermined waveform portion appears, such as the maximum value, the minimum value, or a mean value in the speed variation pattern. The reference timing is considered as a timing at which a virtual reference portion on the intermediate transfer belt 8 in the circumferential direction enters a virtual home position.

For each rotation of the intermediate transfer belt 8, the belt driving control unit stores the number of pulse signals from the subordinate encoder as belt speed data, in the non-volatile RAM at predetermined periods. The properties of temporal changes in the belt speed data during one rotation of the belt indicate the actual speed variation pattern of the intermediate transfer belt 8. Even if the driving speed of the belt driving motor 152 is adjusted, the variation in the speed may not be eliminated completely (remaining speed variation). The actual speed variation pattern corresponds to this remaining speed variation. For each rotation, when belt speed data corresponding to substantially one rotation is obtained, the belt driving control unit analyzes the actual speed variation pattern based on this data. Then, based on the actual speed variation pattern obtained by the analysis and the driving speed adjustment pattern of the belt driving motor 152 applied in the corresponding rotation, the belt driving control unit calculates a new driving speed adjustment pattern with which the speed variation can be further reduced. Specifically, the driving speed pattern previously used is corrected as follows. In the actual speed variation pattern corresponding to the remaining speed variation, each time point has an absolute value (the amplitude at the time point) representing the wave height. The new (corrected) driving speed pattern equalizes these absolute values, and generates a speed variation having an opposite phase by reversing the positive/negative signs at each height. Based on this new (corrected) driving speed pattern and the reference timing, the belt driving control unit fine-adjusts the driving speed of the belt driving motor 152 for the next belt rotation (driving speed adjustment process). Accordingly, the remaining belt speed variation in the previous rotation is cancelled out by performing the driving speed adjustment with the use of the corrected driving speed pattern, so that the intermediate transfer belt 8 moves at a stable speed.

As described above, FIG. 5 only shows the belt speed variation during one rotation of the intermediate transfer belt 8, which is caused by the belt thickness inconsistency in the circumferential direction of the intermediate transfer belt 8. However, the speed variation may occur in a predetermined period and a predetermined occurrence pattern extending over plural rotations of the intermediate transfer belt 8. The belt driving control unit may detect such a speed variation, and use the detection results in controlling the driving speed of the belt driving motor 152. Furthermore, when the belt driving motor 152 is eccentric, this eccentricity causes belt speed variations having the same sine curve as that of the belt thickness inconsistency. It is possible to detect the two superposed sine curves caused by both the belt thickness inconsistency and the eccentricity, and to use these detection results in controlling the driving speed of the belt driving motor 152.

Furthermore, instead of using the pulse signals from the driving encoder, the driving pulses sent to the belt driving motor 152 or the output pulses from a motor encoder for detecting the rotation of the belt driving motor 152 may be used to detect the "speed variation pattern caused by the belt thickness inconsistency" of the intermediate transfer belt 8.

Figure 7:
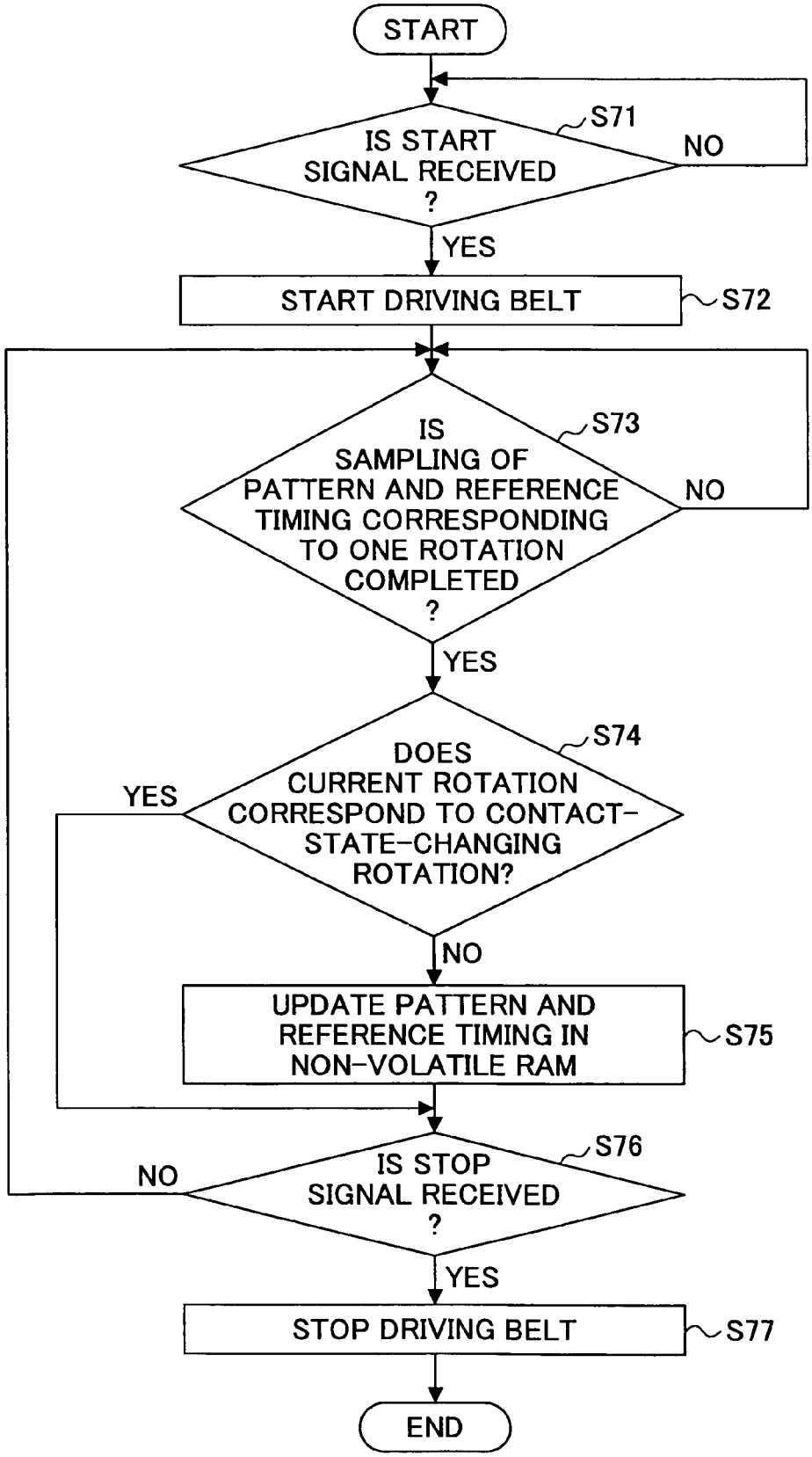
FIG. 7 is a flowchart illustrating a part of a control operation performed by a belt driving control unit of the transfer unit.

FIG. 7 is a flowchart illustrating a part of a control operation performed by the belt driving control unit of the transfer unit 15. When a start signal is received from the main control unit (step S71), the belt driving control unit starts driving the intermediate transfer belt 8 (step S72). In the first rotation of the intermediate transfer belt 8, the driving speed of the belt driving motor 152 is controlled based on the reference timing and the speed variation pattern stored in the non-volatile RAM at the time of the previous image forming operation. Next, when sampling of the speed variation pattern corresponding to one rotation is completed (Yes in step S73), the belt driving control unit determines whether the current rotation for which the speed variation pattern has been sampled corresponds to a contact-state-changing rotation (a rotation during which the number of photoconductors contacting the intermediate transfer belt 8 has changed), based on whether a contact/separation execution signal has been received from the main control unit (step S74). A contact-state-changing rotation occurs in the printer in two cases, i.e., a case where a color mode image forming procedure is performed after a monochrome mode image forming procedure, or a case where a monochrome mode image forming procedure is performed after a color mode image forming procedure. In the former case, the number of photoconductors contacting the intermediate transfer belt 8 is increased from only "1" for K to "4" for Y, M, C, and K. In the latter case, the number of contacting photoconductors is decreased from "4" to only "1" for K. When the belt driving control unit determines that the current rotation for which the speed variation pattern has been sampled does not correspond to a contact-state-changing rotation (No in step S74), the belt driving control unit updates the speed variation pattern and the reference timing stored in the non-volatile RAM to be the sampled new versions (step S75). Subsequently, the belt driving control unit determines whether a stop signal has been received from the main control unit (step S76). When a stop signal has not been received (No in step S76), the control flow returns to step S73. When a stop signal has been received (Yes in step S76), the belt driving control unit stops driving the intermediate transfer belt 8 (step S77).

Meanwhile, when the belt driving control unit determines that the current rotation for which the speed variation pattern has been sampled corresponds to a contact-state-changing rotation in step S74 (Yes in step S74), step S75 is skipped, so that the control flow proceeds from step S74 directly to step S76. That is, for the contact-state-changing rotation, the belt driving control unit does not update the speed variation pattern or the reference timing stored in the non-volatile RAM to be the versions of the contact-state-changing rotation. Accordingly, the speed variation pattern and the reference timing stored in the non-volatile RAM remain as those of the rotation before the contact-state-changing rotation. Therefore, in the rotation after the contact-state-changing rotation, the belt driving control unit controls the driving speed of the belt driving motor 152 based on the speed variation pattern and the reference timing sampled for the rotation before the contact-state-changing rotation. In this manner, when controlling the driving speed of the belt driving motor 152 for the rotation after the contact-state-changing rotation, the reference timing used in the contact-state-changing rotation is not applied for controlling the driving speed of the belt driving motor 152. Rather, the reference timing and the speed variation pattern of the rotation immediately before the contact-state-changing rotation are applied. Accordingly, it is possible to prevent color shift that is caused by an error in determining the reference timing due to contact/separation of the photoconductors and the intermediate transfer belt 8.

Next, a description is given of a printer according to a practical example, in which a more characteristic configuration is added to the printer according to the present embodiment. The basic configuration of the printer according to the practical example is the same as that of the present embodiment, unless otherwise stated.

Practical Example

The belt driving control unit in the transfer unit 15 of the printer according to the practical example performs the following process when the number of photoconductors contacting the intermediate transfer belt 8 (hereinafter, "contacting photoconductor number") decreases from "4" (which is greater than or equal to 2) to "1", in the contact-state-changing rotation. Specifically, in the rotation after such a contact-state-changing rotation, in addition to performing the process of controlling the driving speed of the belt driving motor 152 based on the speed variation pattern sampled in the rotation immediately before the contact-state-changing rotation, a process of fixing the driving speed of the belt driving motor 152 is performed. Specifically, when the determination at step S74 is Yes in the control flow shown in FIG. 7, the belt driving control unit determines whether the contacting photoconductor number has been decreased from "4" to "1", or increased from "1" to "4", based on the contact/separation operation performed in the contact-state-changing rotation. When the contacting photoconductor number has been increased from "1" to "4", the control flow proceeds to step S76. Accordingly, similar to the printer according to the embodiment, in the rotation after the contact-state-changing rotation, the belt driving control unit controls the driving speed of the belt driving motor 152 based on the reference timing and the speed variation pattern sampled for the rotation immediately before the contact-state-changing rotation. Conversely, when the contacting photoconductor number has been decreased from "4" to "1", the speed variation pattern stored in the non-volatile RAM is updated to data of a zero-variation pseudo pattern which is a straight line without any speed variations; as for the reference timing, the value of the rotation immediately before the contact-state-changing rotation is maintained unchanged. Subsequently, the control flow proceeds to step S76. Then, in the rotation after the contact-state-changing rotation, the belt driving motor is driven at a fixed speed while the reference timing and the speed variation pattern are sampled. The time length of driving the belt driving motor 152 at a fixed speed is defined by the reference timing sampled in the rotation immediately before the contact-state-changing rotation. Immediately after the time during which the belt driving motor 152 is driven at a fixed speed has passed, it is considered that the second rotation after the contact-state-changing rotation has started. Then, the belt driving control unit starts controlling the driving speed of the belt driving motor 152 based on the reference timing and the speed variation pattern sampled for the rotation immediately after the contact-state-changing rotation.

In this manner, in the printer according to the practical example, the belt driving control unit is configured to perform, in the rotation after the contact-state-changing rotation, a process of fixing the driving speed of the belt driving motor 152, in the event that the contacting photoconductor number has decreased from "4" to "1" in the contact-state-changing rotation. The belt driving control unit is configured to perform such a process due to the following reasons. That is, when the contacting photoconductor number has decreased from "4" to "1", it means that a monochrome mode image forming operation is performed subsequently. In the monochrome mode, only a K toner image is formed, and the operation of superposing plural toner images is not performed, and therefore even when the speed of the intermediate transfer belt 8 varies, color shift does not occur. Accordingly, even when the belt driving motor 152 is driven at a fixed speed at the contact-state-changing rotation and speed variation occurs due to the belt thickness inconsistency, color shift does not occur. When the belt driving motor 152 is driven at a fixed speed, the rotational angular speed detected by the driving encoder indicates a substantially fixed speed. Therefore, only the speed variation components of the intermediate transfer belt 8 caused by the belt thickness inconsistency can be detected with high precision based on the detection results obtained by the subordinate encoder. Thus, in the rotation after the contact-state-changing rotation, color shift can be prevented while detecting the speed variation pattern of the belt with higher precision compared to the case of controlling the driving speed of the belt driving motor 152 based on the speed variation pattern of the rotation immediately before the contact-state-changing rotation.

Next, a description is given of modifications of the printer according to the present embodiment. The basic configurations of the printers according to the modifications are the same as that of the present embodiment, unless otherwise stated.

[First Modification]

Figure 8:
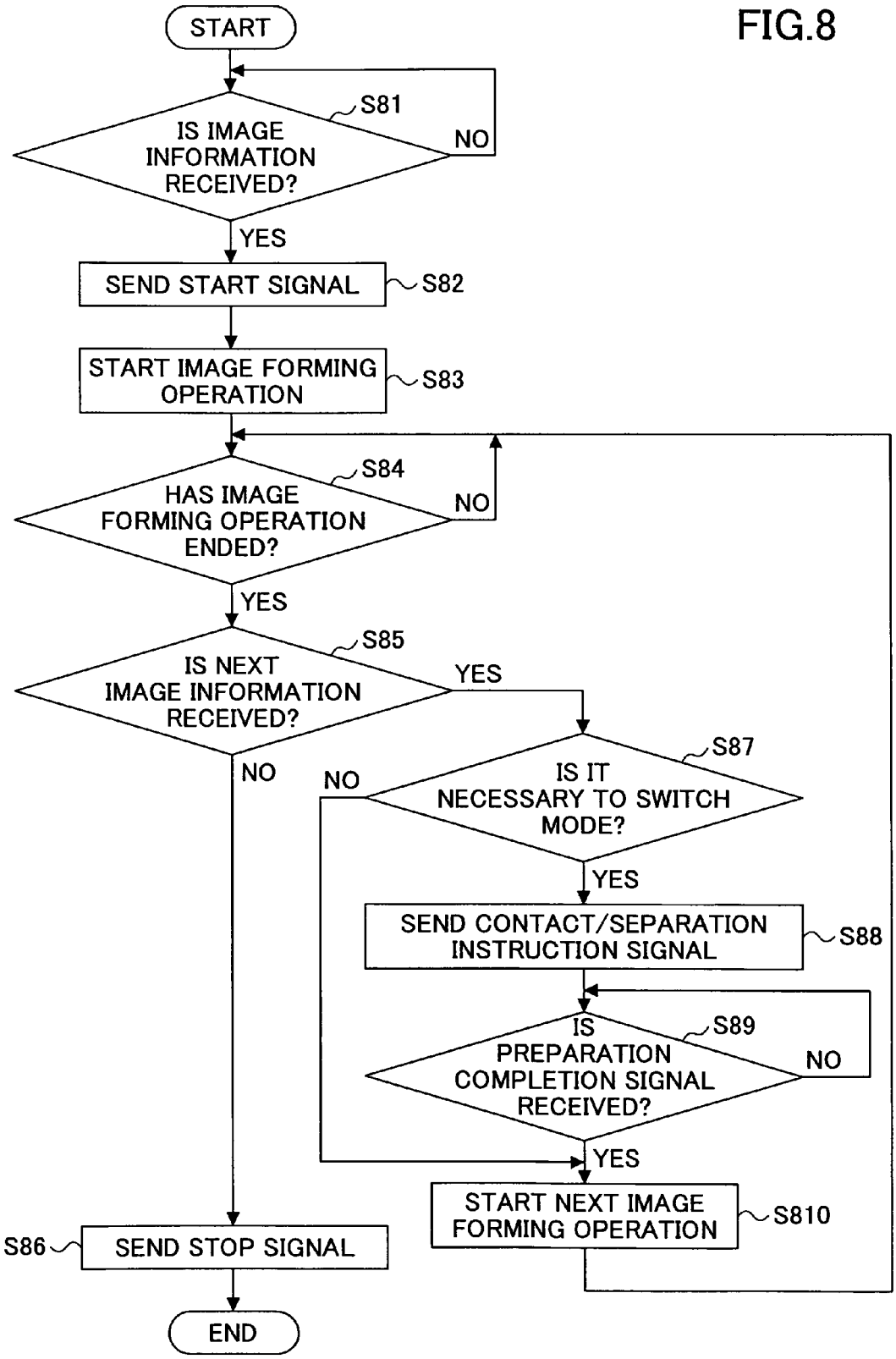
FIG. 8 is a flowchart illustrating a part of a control operation performed by a main control unit included in the printer.

FIG. 8 is a flowchart illustrating a part of a control operation performed by the main control unit of the printer according to a first modification. When image information transmitted from a personal computer (not shown) is received (Yes in step S81), the main control unit sends a start signal to the belt driving control unit of the transfer unit 15 (step S82). When the start signal is received, the belt driving control unit starts driving the belt driving motor 152 as described with reference to FIG. 7.

Next, the main control unit that has sent the start signal to the belt driving control unit starts an image forming operation based on image information (step S83). Specifically, starting the image forming operation means to start driving the process units of the respective colors, and then to cause the optical writing unit 7 to start the optical writing on the photoconductors. When the optical writing on the photoconductors ends (Yes in step S84), the main control unit determines whether the next image information has been received (step S85). When the next image information has not been received (No in step S85), the main control unit sends a stop signal to the belt driving control unit (step S86), and the sequence of the control flow ends. At this point, the other devices are also stopped, such as the process units of the respective colors. The belt driving control unit that has received the stop signal from the main control unit stops driving the belt by stopping the belt driving motor 152 as described above with reference to FIG. 7.

When the next image information has been received (Yes in step S85), next, the main control unit determines whether it is necessary to switch the mode (step S87). To switch the mode means to switch from a monochrome mode to a color mode, or from a color mode to a monochrome mode. When it is not necessary to switch the mode (No in step S87), it is not necessary to perform the contact/separation operation of causing the intermediate transfer belt 8 to contact/separate from the photoconductors 1Y, 1M, and 1C; therefore the optical writing based on the next image information starts without giving a contact/separation instruction to the belt driving control unit (step S810). When the optical writing ends (Yes in step S84), the control flow returns to step S85. Accordingly, when new image information is received, the procedures of steps S87 through S810 are performed. When new image information is not received, the control flow ends after performing the procedure of step S86.

When it is necessary to switch the mode before performing the image forming operation based on the next image information (Yes in step S87), the main control unit sends a contact/separation instruction signal to the belt driving control unit (step S88). The belt driving control unit that has received the contact/separation instruction signal controls the driving speed of the belt driving motor 152 for the rotation after the contact-state-changing rotation, based on the reference timing and the speed variation pattern sampled in the rotation immediately before the contact-state-changing rotation. Then, when the rotation after the contact-state-changing rotation ends, the belt driving control unit sends a preparation completion signal to the main control unit.

When the preparation completion signal has been received from the belt driving control unit (Yes in step S89), as shown in FIG. 8, the main control unit starts the optical writing based on the next image information (step S810). When the image forming operation ends (Yes in step S84), the control flow returns to step S85.

In the printer having the above configuration, a non-image forming rotation is performed as the rotation after the contact-state-changing rotation, before the optical writing unit 7 performs optical writing while continuing to drive the intermediate transfer belt 8. This non-image forming rotation is not for starting optical scanning, but for sampling the reference timing and the speed variation pattern of the intermediate transfer belt 8 based on the difference between the detection results of the driving encoder and the subordinate encoder, while controlling the driving speed of the belt driving motor 152 based on the speed variation pattern detected in the rotation immediately before the contact-state-changing rotation. After the non-image forming rotation is performed, an image forming rotation is performed for starting the optical scanning while controlling the driving speed of the belt driving motor 152 based on the reference timing and the speed variation pattern sampled in the non-image forming rotation.

In the contact-state-changing rotation, the driving speed of the intermediate transfer belt 8 is temporarily increased or decreased due to a rapid change in the driving load caused by the contact/separation of the photoconductors. Therefore, the reference timing of the contact-state-changing rotation is slightly different from that of the rotation immediately before the contact-state-changing rotation. Nevertheless, in the printer according to the present embodiment, the timing when the contact-state-changing rotation ends and the timing when the rotation after the contact-state-changing rotation ends are specified based on the reference timing of the rotation immediately before the contact-state-changing rotation. For this reason, in the rotation after the contact-state-changing rotation, a slight phase difference arises between the driving speed variation pattern and the actual belt speed variation pattern. This slight phase difference decreases the precision in stabilizing the belt speed.

Conversely, in the printer according to the first modification, the rotation after the contact-state-changing rotation is a non-image forming rotation. The reference timing and the speed variation pattern in the non-image forming rotation are sampled before starting the optical writing in the next rotation. Therefore, when performing the optical writing, the speed of the intermediate transfer belt 8 can be stabilized with high precision. Accordingly, the belt speed is prevented from becoming unstable due to a phase difference between the driving speed variation pattern and the actual belt speed variation pattern.

In the above-described modification, in the rotation after the contact-state-changing rotation, the driving speed of the belt driving motor 152 is controlled based on the speed variation pattern sampled in the rotation before the contact-state-changing rotation. However, in the rotation after the contact-state-changing rotation, the belt driving motor 152 may be driven at a fixed speed. The rotation after the contact-state-changing rotation is a non-image forming rotation, and therefore even if a belt speed variation were caused by the belt thickness inconsistency, the image would be unaffected.

In the printer according to the first modification, when the contacting photoconductor number decreases from "4" to "1" in the contact-state-changing rotation, instead of performing a non-image forming rotation after the contact-state-changing rotation, in the rotation after the contact-state-changing rotation, optical writing is started while maintaining the belt driving motor 152 at a fixed speed. Accordingly, similar to the printer according to the practical example, when the mode is switched from a color mode to a monochrome mode, color shift can be prevented while detecting the speed variation pattern of the belt with higher precision compared to the case of controlling the driving speed based on the speed variation pattern of the rotation immediately before the contact-state-changing rotation.

[Second Modification]

The main control unit of a printer according to a second modification performs the control operation shown in FIG. 8, similar to the printer according to the first modification. As described above, in this control operation, the main control unit sends a contact/separation instruction signal to the belt driving control unit (step S88), receives a preparation completion signal from the belt driving control unit (Yes in step S89), and starts the next optical writing operation (step S810).

The belt driving control unit of the transfer unit 15 receives the contact/separation instruction signal from the main control unit, and then causes the intermediate transfer belt 8 to contact the photoconductors 1Y, 1M, and 1C for Y, M, and C, or to separate from the photoconductors 1Y, 1M, and 1C, in accordance with the contact/separation instruction signal. This rotation of the intermediate transfer belt 8 is a contact-state-changing rotation. The belt driving control unit determines whether the rotation immediately before the current rotation has also been a contact-state-changing rotation, i.e., whether a contact/separation operation for the belt has been performed in the rotation immediately before the current rotation. In the printer, depending on the size of the recording sheet or the printing direction, the optical writing, developing, secondary transfer, and the contact/separation operation for the belt can be completed within one rotation. Accordingly, when monochrome image formation and color image formation are alternately performed on one recording sheet, depending on the size of the recording sheet or the printing direction, a contact-state-changing rotation may be continuously performed. When the belt driving control unit receives a contact/separation instruction signal from the main control unit and performs a contact/separation operation for the belt, the belt driving control unit determines whether the previous rotation has been a contact-state-changing rotation.

When a contact-state-changing rotation has been performed immediately before the current rotation in which the contact/separation operation is performed, the belt driving control unit performs the same control operation as that of the first modification. That is, a non-image forming rotation is performed immediately after the latest (most recent) contact-state-changing rotation, and then a preparation completion signal is sent to the main control unit. Then, in the rotation after the non-image forming rotation, optical writing for the next image is started.

Meanwhile, when the rotation immediately before the most recent contact-state-changing rotation is not a contact-state-changing rotation, the belt driving control unit sends a preparation completion signal to the main control unit immediately as the rotation after the most recent contact-state-changing rotation starts. The belt driving control unit controls the driving speed of the belt driving motor 152 based on the reference timing and the speed variation pattern sampled in the rotation immediately before the most recent contact-state-changing rotation.

In the printer that performs a control operation in the above manner, when the rotation before the most recently detected contact-state-changing rotation is not a contact-state-changing rotation, a first process is executed. When the rotation before the most recently detected contact-state-changing rotation is a contact-state-changing rotation, a second process is executed. The first process is for controlling the driving speed of the belt driving motor 152 for the rotation after the contact-state-changing rotation based on the speed variation pattern detected in the rotation immediately before the contact-state-changing rotation. The second process is for performing, after the contact-state-changing rotation, a non-image forming rotation without starting optical writing, before the optical writing is to start while continuing to drive the intermediate transfer belt 8, in a manner similar to the printer according to the first modification.

For the purpose of stabilizing the belt speed, instead of starting optical writing in the rotation after the contact-state-changing rotation as in the printer according to the embodiment, it is preferable to start optical writing after a non-image forming rotation performed after the contact-state-changing rotation as in the printer according to the first modification. However, when a non-image forming rotation is performed, the timing of starting optical writing is delayed by at least one rotation of the belt, and therefore the user's waiting time is increased. Thus, for the purpose of reducing the waiting time of the user, the optical writing is preferably started in the rotation after the contact-state-changing rotation, without performing a non-image forming rotation. In the rotation after the contact-state-changing rotation, as described above, a slight phase difference arises between the driving speed variation pattern of the belt driving motor 152 and the actual belt speed variation pattern. When contact-state-changing rotations are not continuously performed, this phase difference is not that large, and therefore color shift caused by the phase difference is not that significant. However, when contact-state-changing rotations are continuously performed, errors in detecting the reference timings in the respective contact-state-changing rotations are accumulated. As a result, the phase difference becomes relatively large, which may lead to considerable color shift.

Therefore, in the printer, when the rotation before the most recently detected contact-state-changing rotation is not a contact-state-changing rotation, the first process is executed, so that reducing the user's waiting time is prioritized over stabilizing the belt speed. Conversely, when the rotation before the most recently detected contact-state-changing rotation is a contact-state-changing rotation, the second process is executed, so that stabilizing the belt speed is prioritized over reducing the user's waiting time. With such a configuration, when the possibility of significant color shift is low, reducing the user's waiting time can be prioritized over stabilizing the belt speed. Meanwhile, when the possibility of significant color shift is high, stabilizing the belt speed can be prioritized over reducing the user's waiting time.

[Third Modification]

A printer according to a third modification is different from the printer according to the second modification as described below, but is otherwise the same as that of the second modification. That is, in the printer according to the third modification, a user operates an operations display unit including a numeric keypad and a display (not shown), to specify a continuation threshold for causing each control unit to determine the number of times the contact-state-changing rotation is to be continuously performed before executing the second process.

When the belt driving control unit receives a contact/separation instruction signal from the main control unit and performs the contact/separation operation for the belt, the belt driving control unit identifies the most recent number of continuous contact-state-changing rotations, including the current rotation. For example, when the rotation before the current rotation is not a contact-state-changing rotation, the number of continuous contact-state-changing rotations is "1". When the current rotation and the rotation immediately before the current rotation are continuous contact-state-changing rotations, the number is "2". When the number of continuous contact-state-changing rotations is identified, the belt driving control unit compares this identified result with the above-described continuation threshold. When the identified result is greater than the continuation threshold, the belt driving control unit executes the second process. When the identified result is less than or equal to the continuation threshold, the belt driving control unit executes the first process. For example, when the number of continuous contact-state-changing rotations is "2" and the continuation threshold is "1", the second process is executed.

In such a configuration, the user can specify the number of continuous contact-state-changing rotations to be performed before executing the second process for prioritizing stabilization of the belt speed instead of executing the first process for prioritizing reduction of the user's waiting time.

In the above described printer, toner images of respective colors formed on corresponding photoconductors are superposed on the intermediate transfer belt 8 acting as a belt member by a primary transfer procedure. Then, the toner images are transferred at once onto a recording sheet by a secondary transfer procedure. Instead of such a configuration, the present invention is also applicable to an image forming apparatus in which the toner images of respective colors formed on corresponding photoconductors are directly superposed onto a recording sheet being held on the surface of a sheet conveying belt acting as the belt member.

An image forming apparatus in which the intermediate transfer belt 8 is caused to contact/separate from the photoconductor, is described above. The present invention is also applicable to an image forming apparatus in which a belt member is caused to contact/separate from opposing members such as the belt cleaning device 10 and the secondary transfer bias roller 19.

An example of using a rotary encoder as the first detecting unit is described above. When a stepping motor is used as the belt driving motor 152, a motor driver for supplying driving pulses to the stepping motor can also be used as the first detecting unit.

In the printer according to the embodiment, the belt driving control unit is configured to control the driving speed of the belt driving motor 152 in the rotation after the contact-state-changing rotation, based on the speed variation pattern detected in the rotation immediately before the contact-state-changing rotation. With such a configuration, the printer can establish a driving speed variation pattern of the belt driving motor 152 in the rotation after the contact-state-changing rotation, based on the speed variation pattern detected in the rotation immediately before the contact-state-changing rotation.

In the printer according to the present embodiment, when the contacting photoconductor number, which is the number photoconductors contacting the intermediate transfer belt 8, decreases from "4" (which is greater than or equal to 2) to "1" in a contact-state-changing rotation, in the rotation after the contact-state-changing rotation, the belt driving control unit performs a process of fixing the driving speed of the belt driving motor 152 instead of a process of controlling the driving speed of the belt driving motor 152 based on the speed variation pattern detected in the rotation immediately before the contact-state-changing rotation. In such a configuration, as described above, when the image forming operation after the contact/separation operation is in a monochrome mode, color shift can be prevented while detecting the speed variation pattern of the belt with higher precision compared to the case of controlling the driving speed of the belt driving motor 152 based on the speed variation pattern of the rotation immediately before the contact-state-changing rotation.

In the printer according to the first modification, the main control unit acting as an image forming control unit, and the belt driving control unit are configured as follows. After the contact-state-changing rotation, a non-image forming rotation is performed without starting optical writing, before performing the next image forming operation while continuing to drive the intermediate transfer belt 8. Specifically, the non-image forming rotation is for determining the reference timing and the speed variation pattern based on the difference between the detection results of the two encoders, while controlling the driving speed of the belt driving motor 152 based on the speed variation pattern that has been detected in the rotation immediately before the contact-state-changing rotation (or while fixing the driving speed). Then, after the non-image forming rotation, an image forming rotation is performed for starting optical writing, while controlling the driving speed of the belt driving motor 152 based on the reference timing and the speed variation pattern detected in the non-image forming rotation. With such a configuration, as described above, compared to the case of not performing a non-image forming rotation, the belt speed can be further prevented from becoming unstable due to the phase difference between the driving speed variation pattern and the actual belt speed variation pattern.

In the printer according to the first modification, the main control unit and the belt driving control unit are configured as follows. When the contacting photoconductor number decreases from "4" (which is greater than or equal to 2) to "1" in the contact-state-changing rotation, instead of executing the process of performing a non-image forming rotation and then an image forming rotation, a process of starting the optical writing is executed in the rotation after the contact-state-changing rotation while fixing the driving speed of the belt driving motor 152. In such a configuration, as described above, when the image forming operation after the contact/separation operation is in a monochrome mode, color shift can be prevented while detecting the speed variation pattern of the belt with higher precision compared to the case of controlling the driving speed of the belt driving motor 152 based on the speed variation pattern of the rotation immediately before the contact-state-changing rotation.

In the printer according to the second modification, the main control unit and the belt driving control unit are configured to select either the first process or the second process. The first process is for controlling the driving speed of the belt driving motor 152 for the rotation after the contact-state-changing rotation based on the speed variation pattern detected in the rotation immediately before the contact-state-changing rotation. The second process is for performing, after the contact-state-changing rotation, a non-image forming rotation, and then an image forming rotation. By selecting either one of the processes, it is possible to select whether to prioritize reduction of the user's waiting time over stabilization of the belt speed, or to prioritize stabilization of the belt speed over reduction of the user's waiting time.

In the printer according to the second modification, the main control unit and the belt driving control unit are configured as follows. When the rotation before the most recently detected contact-state-changing rotation is not a contact-state-changing rotation, a first process is executed. When the rotation before the most recently detected contact-state-changing rotation is a contact-state-changing rotation, a second process is executed. In such a configuration, as described above, when the possibility of significant color shift is low, reduction of the user's waiting time can be prioritized over stabilization of the belt speed. Meanwhile, when the possibility of significant color shift is high, stabilization of the belt speed can be prioritized over reduction of the user's waiting time.

In the printer according to the third modification, the main control unit and the belt driving control unit are configured to select the first process or the second process based on a comparison between the number of continuous contact-state-changing rotations and the continuation threshold which is a value specified by the operator. In such a configuration, as described above, the user can specify the number of continuous contact-state-changing rotations to be performed before executing the second process for prioritizing stabilization of the belt speed instead of executing the first process for prioritizing reduction of the user's waiting time.

According to an embodiment of the present invention, the reference timing of a belt member is determined based on the waveform of a speed variation pattern of the belt member, and therefore the reference timing of the belt member can be determined without the need of a home position sensor that incurs increased cost.

According to an embodiment of the present invention, in a contact-state-changing rotation in which there is a high possibility that the waveform of the speed variation pattern of the belt member becomes considerably irregular, the belt driving control unit does not determine the reference timing of the belt member, or even if the belt driving control unit does determine the reference timing, the determined result is not used in controlling the driving speed of the driving source in the next rotation. In the rotation after the contact-state-changing rotation, the belt driving control unit controls the driving speed of the driving source based on the result obtained by determining the reference timing in the rotation immediately before the contact-state-changing rotation to stabilize the moving speed of the belt member. In this manner, the result obtained by determining the reference timing in the contact-state-changing rotation is not used in controlling the driving speed of the driving source in the rotation after the contact-state-changing rotation. Instead, the result obtained by determining the reference timing in the rotation immediately before the contact-state-changing rotation is used in the rotation after the contact-state-changing rotation. Therefore, it is possible to prevent color shift caused by errors in determining the reference timing when an image carrier or an opposing member contacts/separates from a belt member.

The present invention is not limited to the specifically disclosed embodiment, and variations and modifications may be made without departing from the scope of the present invention.

The present application is based on Japanese Priority Patent Application No. 2008-100143, filed on Apr. 8, 2008, and Japanese Priority Patent Application No. 2008-182205, filed on Jul. 14, 2008, the entire contents of which are hereby incorporated herein by reference.

What is claimed is:

1. A belt driving device installed in an image forming apparatus, wherein the image forming apparatus comprises:

plural image carriers each configured to carry a visible image;

a visible image forming unit configured to form the visible images on the corresponding image carriers;

an image forming control unit configured to control the visible image forming unit;

a transfer unit configured to transfer the visible images on the image carriers so as to be superposed on a surface of a belt member having an endless form configured to endlessly move, or on a recording member held on the surface; and a contact/separation unit configured to cause the surface of the belt member to contact/separate from at least one of the image carriers, or to cause the belt member to contact/separate from an opposing member facing the belt member, wherein the belt driving device comprises:

a driving rotary body configured to endlessly move the belt member by a rotational drive thereof, while having an inner loop of the belt member stretched around the driving rotary body;

a subordinate rotary body configured to be rotated by the endless movement of the belt member while being in contact with the belt member;

a first detecting unit configured to detect a driving speed at which the driving rotary body is driven;

a second detecting unit configured to detect rotational angular displacement or a rotational angular speed of the subordinate rotary body; and a belt driving control unit configured to determine a reference timing of a preceding rotation of the belt member and a speed variation pattern of the belt member during the preceding rotation based on detection data obtained by the first detecting unit in the preceding rotation and detection data obtained by the second detecting unit in the preceding rotation, and to control, during a succeeding rotation which is continuously performed after the preceding rotation, the driving speed of a driving source configured to drive the driving rotary body, based on the reference timing and the speed variation pattern, wherein:

during a rotation of the belt member after a contact-state-changing rotation, the belt driving control unit controls the driving speed of the driving source based on a reference timing determined in a rotation of the belt member before the contact-state-changing rotation, instead of a reference timing determined in the contact-state-changing rotation, wherein the contact-state-changing rotation corresponds to a rotation of the belt member in which a number of the image carriers contacting the belt member changes, or a rotation of the belt member in which the opposing member that has been separated from the belt member comes in contact with the belt member, or a rotation of the belt member in which the opposing member that has been in contact with the belt member separates from the belt member.

2. An image forming apparatus comprising:

plural image carriers each configured to carry a visible image;

a visible image forming unit configured to form the visible images on the corresponding image carriers;

an image forming control unit configured to control the visible image forming unit;

a transfer unit configured to transfer the visible images on the image carriers so as to be superposed on a surface of a belt member having an endless form configured to endlessly move, or on a recording member held on the surface; and a contact/separation unit configured to cause the surface of the belt member to contact/separate from at least one of the image carriers, or to cause the belt member to contact/separate from an opposing member facing the belt member; and the belt driving device according to claim 1 configured to drive the belt member.

3. The image forming apparatus according to claim 2, wherein:

in the rotation after the contact-state-changing rotation, the belt driving control unit controls the driving speed of the driving source based on a speed variation pattern detected in the rotation before the contact-state-changing rotation.

4. The image forming apparatus according to claim 3, wherein:

in the event that the number of image carriers contacting the belt member decreases from greater than or equal to 2 to 1 in the contact-state-changing rotation, the belt driving control unit fixes the driving speed of the driving source in the rotation after the contact-state-changing rotation instead of controlling the driving speed based on the speed variation pattern detected in the rotation before the contact-state-changing rotation.

5. The image forming apparatus according to claim 2, wherein the image forming control unit and the belt driving control unit are configured to perform a process of:

providing a non-image forming rotation without forming the visible image after the contact-state-changing rotation, before causing the visible image forming unit to form the visible image while continuously driving the belt member, determining, in the non-image forming rotation, a reference timing and a speed variation pattern of the belt member based on the detection data obtained by the first detecting unit and the detection data obtained by the second detecting unit, while controlling the driving speed of the driving source based on a speed variation pattern detected in the rotation before the contact-state-changing rotation, or while fixing the driving speed, and after the non-image forming rotation, providing an image forming rotation in which the visible image forming unit starts forming the visible image while the driving speed is controlled based on the reference timing and the speed variation pattern determined in the non-image forming rotation.

6. The image forming apparatus according to claim 5, wherein:

in the event that the number of image carriers contacting the belt member decreases from greater than or equal to 2 to 1 in the contact-state-changing rotation, instead of performing the process of providing the non-image forming rotation and the image forming rotation, the image forming control unit and the belt driving control unit perform a process in the rotation after the contact-state-changing rotation for causing the visible image forming unit to start forming the visible image while fixing the driving speed of the driving source.

7. The image forming apparatus according to claim 2, wherein the image forming control unit and the belt driving control unit are configured to select and execute a first process or a second process, wherein:

the first process is for controlling the driving speed of the driving source in the rotation after the contact-state-changing rotation based on a speed variation pattern detected in the rotation before the contact-state-changing rotation; and the second process is for providing a non-image forming rotation after the contact-state-changing rotation without forming the visible image after the contact-state-changing rotation, before causing the visible image forming unit to form the visible image while continuously driving the belt member, determining, in the non-image forming rotation, a reference timing and a speed variation pattern of the belt member based on the detection data obtained by the first detecting unit and the detection data obtained by the second detecting unit, while controlling the driving speed of the driving source based on a speed variation pattern detected in the rotation before the contact-state-changing rotation, or while fixing the driving speed, and after the non-image forming rotation, providing an image forming rotation in which the visible image forming unit starts forming the visible image while the driving speed is controlled based on the reference timing and the speed variation pattern detected in the non-image forming rotation.

8. The image forming apparatus according to claim 7, wherein:

the image forming control unit and the belt driving control unit are configured to perform the first process in the event that a rotation before a most-recently-detected contact-state-changing rotation is not a contact-state-changing rotation, and to perform the second process in the event that a rotation before a most-recently-detected contact-state-changing rotation is a contact-state-changing rotation.

9. The image forming apparatus according to claim 7, wherein:

the image forming control unit and the belt driving control unit are configured to determine to select the first process or the second process based on a comparison between a number of continuous contact-state-changing rotations and a value specified by an operator.

* * * * *